United States Patent [19]

Badenhoop et al.

[11] Patent Number: 4,779,022

[45] Date of Patent: Oct. 18, 1988

[54] COOLING STRUCTURE FOR A SCREEN GRID ELECTRON TUBE SUCH AS A TRANSMITTER TETRODE

[75] Inventors: Rainer Badenhoop; Ingo Beling, both of Berlin, Fed. Rep. of Germany

[73] Assignee: Siemens Aktiengesellschaft, Berlin and Munich, Fed. Rep. of Germany

[21] Appl. No.: 60,815

[22] Filed: Jun. 12, 1987

[30] Foreign Application Priority Data

Jul. 30, 1986 [DE] Fed. Rep. of Germany ..... 3625843

[51] Int. Cl.[4] ..... H01J 7/26; H01J 19/74

[52] U.S. Cl. ..... 313/37; 313/30; 313/35; 313/296

[58] Field of Search ..... 313/18, 19, 20, 21, 313/35, 36, 39, 30, 296; 331/98, 101; 315/39

[56] References Cited

U.S. PATENT DOCUMENTS

| | | | |
|---|---|---|---|
| 3,227,905 | 1/1966 | Talcott | 313/39 |
| 3,567,982 | 3/1971 | Droppa et al. | 313/39 |
| 3,641,380 | 2/1972 | Stephens | 313/39 |
| 4,295,077 | 10/1981 | Carter et al. | 313/299 |
| 4,302,701 | 11/1981 | Beling | 313/299 |
| 4,639,633 | 1/1987 | Hoet et al. | 313/39 |
| 4,644,217 | 2/1987 | Hoet et al. | 313/39 |

FOREIGN PATENT DOCUMENTS

| | | |
|---|---|---|
| 872609 | 4/1953 | Fed. Rep. of Germany . |
| 0162754 | 4/1985 | Fed. Rep. of Germany . |

OTHER PUBLICATIONS

Senderoehren-Datenbuch 1980/81, p. 147, Published Siemens AG Bereich Bauelemente, Munich Federal Republic of Germany.

NTG-Fachberichte, 1983, pp. 1928-1932, Published by VD-Verlag Berlin, ISBN 3-8007-1321-7.

*Primary Examiner*—David K. Moore

*Assistant Examiner*—Mark R. Powell

*Attorney, Agent, or Firm*—Hill, Van Santen, Steadman & Simpson

[57] ABSTRACT

A cooling system for a screen grid electron tube such as a high power, high frequency transmitter tetrode which has coaxial formed electrodes and bushings and has an air cool screen grid terminal formed of two angular screen grid terminal elements 1 and 2 spaced from each other in the axial direction together with their bushings 3 and 4 so as to form a cooling air coaxial passage 7 so as to cool the screen grid terminal elements 1 and 2.

4 Claims, 1 Drawing Sheet

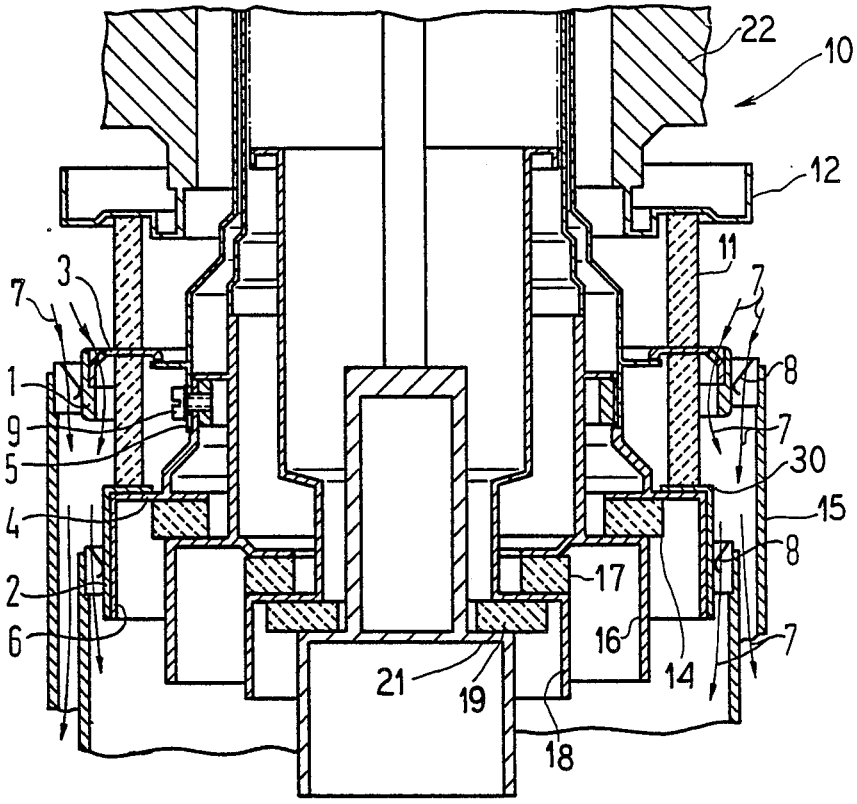
22
10
12
11
7
3
7
1
9
5
4
2
6
8
7
30
15
8
17
16
7
14
21
19
18

COOLING STRUCTURE FOR A SCREEN GRID ELECTRON TUBE SUCH AS A TRANSMITTER TETRODE

BACKGROUND OF THE INVENTION

1. Field of the Invention

This invention relates in general to a screen grid electron tube and particularly to a construction for cooling such tube.

2. Description of the Prior Art

Radio frequency currents cause additional losses in the operation of electron tubes at high frequency. This is particularly true for transmitter tubes which are operated with high AC anode voltages. The radio frequency currents produced by the AC anode voltage produce losses in the screen anode space on the leads and on the electrodes that must be provided for special cooling.

In radio frequency tube power amplifiers having frequencies from 100 MHz through 1000 MHz, in other words, in the VHF or the UHF range, particularly in the IV/V range, the cooling of the tube terminals presents a considerable problem. When operating at high frequencies, tubes must be short and compact as possible. However, this makes it more and more difficult to eliminate the heat generated.

Particularly, in high powered tubes for transmitters in the IV/V UHF range, the dimensions such as the length of the system and the length of the leads are extremely short due to the electrical wave length. Also, the thermal conductivity of the materials commonly used in tube technology is so high that heat elimination occurs by way of the terminals and these must therefore be appropriately cooled.

When using high powered tetrodes and power amplifiers such as cavity resonators, the cooling of the screen grid terminals requires special structural and cooling means.

Due to the radio frequency losses which occur at high frequencies, it is known to provide the screen grid terminal ring with a special air cooling guidance so that forced air cooling of this portion of the tube will occur. Two rows of rectangular openings are provided in this air cooling channel on both sides of the terminal surface to serve for the admission of air and the discharge of air. See for example, Senderoehren-Datenbuch 1980/1981, Page 147, Published by Siemens AG, Bereich Bauelemente, Munich, Federal Republic of Germany.

Transmitter tubes are also known wherein the screen grid terminal contains an integrated water cooling coil instead of an air cooling means and see, for example, NTG-Fachberichte, 1983, Pages 128–132, published by VDE-Verlag, Berlin, ISBN 3-8007-13217-7. Such cooling mechanism, however, makes it very difficult and time consuming to change a tube.

SUMMARY OF THE INVENTION

It is an object of the present invention to reduce the stray heat occurring at the tube terminals, particularly at the screen grid terminal and to improve the elimination of the heat and, thus, to create an efficient tube cooling system which requires very little technological outlay. Also, a complete separation of the radio frequency currents of the anode screen grid space and of the control grid screen space is obtained.

It is a feature of the invention to provide a screen grid electron tube such as a transmitter tetrode for high power and high frequencies which has a coaxial structure of the electrodes and bushings and has an air cooled screen grid terminal wherein the screen grid terminal is composed of two annular screen grid terminals elements 1 and 2 which are spaced from one another in the axial direction and together with their bushings 3 and 4 form a coaxial cooling guide passage 7 in the region of the screen grid terminal elements 1 and 2.

Other objects, features and advantages of the invention will be apparent from the following descrition of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

The FIGURE illustrates a tetrode tube according to the invention in sectional view.

DESCRIPTION OF THE PREFERRED EMBODIMENTS

According to the invention, two separate screen grid terminal elements such as contact rings and bushings or washer-shaped elements are provided for an electron tube particularly for a transmitter tetrode. The first bushing or washer-shaped element is composed of a material having good thermal conductivity and low radio frequency losses. This material can be easily cooled as a result of its design and of its physical properties. Also, it is advantageous in that the length of the system determined by the electrical wave length can be kept very short independently of the mechanical requirements. The second bushing or washer-shaped element is used for the mechanical structure and for fastening the screen grid and closing the vacuum envelope. The materials are selected giving consideration to the mechanical stress and the thermal expansion of the screen grid which is connected thereto using screws, for example. A significant advantage is that cooling air guide passage which permits the temperature of the tube to be controlled is achieved by the use of the double screen grid bushing or washer-shaped elements. Also, it is especially advantageous that a complete separation of the radio frequency currents of the anode screen grid $G_2$ space and of the control grid $G_1$ screen grid $G_2$ space is obtained using the double screen grid terminals. Electrical coupling which conventionally arrives at the screen grid contact springs is not possible with the invention.

The FIGURE is a partial sectional view of tetrode tube with the features of the invention.

The FIGURE schematically illustrates a portion of a transmitter tetrode as an exemplary embodiment. The transmitter tetrode essentially comprises a coaxial structure of the electrodes including the cathode, the control grid, the screen grid and the anode as well as the bushings or washer-shaped elements. The terminal of the screen grid 5 is composed of two annular screen grid terminal elements in the form of contact rings 1 and 2 which are spaced from each other in the axial direction. With the associated bushings or washer-shaped members 3 and 4, the two screen grid terminal elements 1 and 2 form a coaxial air cooling passage or channel which is indicated by the arrows 7. The annular screen grid terminal elements 1 and 2 are formed of a metal or alloy having high thermal conductivity and is preferably copper. The first bushing or washer-shaped element 3 is formed of a material having good thermal conductivity and having low radio frequency losses and is preferably formed of copper. The second bushing or washer-shaped element 4 is composed of a mechanical stable material which has a coefficient of thermal expansion which matches that of the preferred metal-ceramic material employed in the vacuum envelope 6. An iron-cobalt nickel alloy is especially suitable as a material for the second bushing or washer-shaped element 4 so as to obtain a vacuum tight metal-ceramic construction for the vacuum envelope. The ceramic material thus serves as an insulating space between the individual metal ceramic connections, or respectively, bushings or washer-shaped elements of the tetrode. The screen grid 5 is connected to the second bushing or washer-shaped element 4 by means of a screw 9. The contact springs 8 connected to the screen grid terminal elements contact rings 1 and 2 at the outside in the form of a screen grid spring collar form a nearly unimpeded coaxial air cooling guide passage so that air can pass therethrough in the direction of the arrows 7.

In the FIG., the tube 10 includes an upper cylindrical member 22 which is connected to an annular member 12 which is joined by a ceramic envelope 11 to a lower annular member 30. The lower bushing or washer-shaped element 4 is connected to the member 30 and an annular ceramic member 14 is mounted between the member 4 and a lower annular structure 16. Ceramic washer 17 is mounted between the member 16 and annular member 18. A ceramic annular member 19 is mounted between the member 18 and a central portion 21 of the tube.

It is to be noted that the bushing 3 extends through the ceramic member 11 and that air as shown by the arrows 7 can pass between the bushing 3 and the ceramic cylindrical member 11 as well as between the outer surface of the member 3 and the member 15. Air can also pass between the members 14 and 15 as shown.

It is seen that the invention provides an improved tetrode tube with improved cooling and although it has been described with respect to preferred embodiments, it is not to be so limited as changes and modifications can be made therein which are within the full intended scope as defined by the appended claims.

We claim as our invention:

1. Apparatus for cooling a screen-grid electron tube having an envelope such as a transmitter tetrode which operates at high power and at high frequencies and which is mounted in a tube holder, said tube having two annular screen-grid terminal elements (1, 2) which are coaxially arranged and are axially spaced from one another, said tube holder having two annular coaxially arranged and axially spaced bushings into which said two annular screen-grid terminal elements (1,2) are mounted and said two bushings (3, 4), forming coaxial cooling air passages (7) between said bushings and said screen-grid terminal elements (1, 2).

2. Apparatus for cooling a screen-grid electron tube according to claim 1, wherein said annular screen-grid terminal elements (1, 2) are formed of a metal or alloy which has high thermal conductivity; and a first one of said two bushings (3) is formed of a material which has good thermal conductivity and low radio-frequency losses and a second one of said two bushings (4) is formed of a mechanically stable material which has a thermal expansion coefficient which matches that of the metal-ceramic material used in the vacuum envelope (6).

3. Apparatus for cooling a screen-grid electron tube according to claim 1 or 2, wherein the first of said two annular screen-grid terminal elements (1) and the first of said two bushing (3) are formed of copper and the second one of said two screen-grid terminal elements (2) and the second of said two bushings bushing (4) are formed of an iron-cobalt-nickel alloy.

4. Apparatus for cooling a screen-grid electron tube according to claim 1 wherein said tube is used as a transmitter tetrode in radio-frequency tube power amplifiers such as cavity resonators.

* * * * *